United States Patent [19]

Stegmeier

[11] 3,987,997

[45] Oct. 26, 1976

[54] APPARATUS FOR CONFINING A FORM BOARD AGAINST A WALL

[76] Inventor: William J. Stegmeier, 1073 Shary Circle, Concord, Calif. 94520

[22] Filed: Sept. 27, 1974

[21] Appl. No.: 507,248

Related U.S. Application Data

[63] Continuation-in-part of Ser. No. 438,018, Jan. 30, 1974, Pat. No. 3,904,717.

[52] U.S. Cl. ..... 249/207; 249/19; 249/DIG. 3

[51] Int. Cl.[2] ..... E04G 17/14

[58] Field of Search ..... 249/DIG. 3, 1, 10, 13, 249/18–20, 205, 207, 210; 269/321 S, 321 W; 52/169, 749, 698–700; 85/30

[56] References Cited

UNITED STATES PATENTS

| | | | |
|---|---|---|---|
| 2,048,234 | 7/1936 | Tucker | 52/698 |
| 3,348,801 | 10/1967 | Deason | 249/DIG. 3 |
| 3,472,477 | 10/1969 | Juhl | 249/20 |

FOREIGN PATENTS OR APPLICATIONS

| | | | |
|---|---|---|---|
| 937,372 | 12/1946 | France | 249/10 |
| 906,274 | 12/1945 | France | 249/10 |

*Primary Examiner*—Ronald J. Shore
*Assistant Examiner*—John McQuade
*Attorney, Agent, or Firm*—C. Michael Zimmerman

[57] ABSTRACT

Holder structure is described for confining board structures and the like against a concrete side wall of a swimming pool during its construction. The holder structure includes an anchor for securing the same to the concrete wall. The anchor has a laterally extending barb and a packing member which cooperate to assure that the anchor is firmly held by the concrete wall. An elongated spring holder is mounted on a projecting shank of the anchor by a one-way lock washer so as to develop a lever bending moment which forces a board against the concrete wall and thereby maintains the same in position. The spring holder includes a laterally extending cross-member having a pair of board engaging points on each side of a main longitudinal leg of the spring holder, so that it will stably engage the board structure to be confined against the pool side wall. The spring holder further includes an elongated slot along its length within which the shank of the anchor is received in sliding relation thereto so that the holder is adjustable on the anchor to change the distance from the anchor at which the cross member engages a board structure.

7 Claims, 13 Drawing Figures

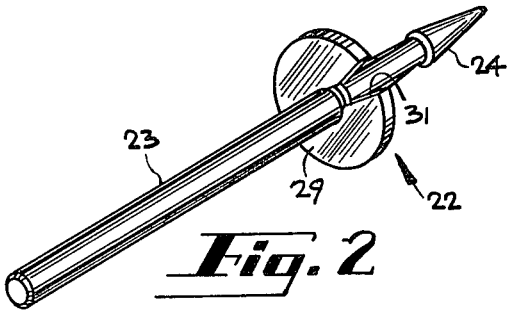
Fig. 2
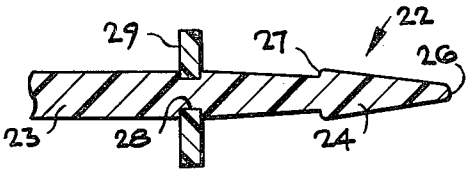
Fig. 3
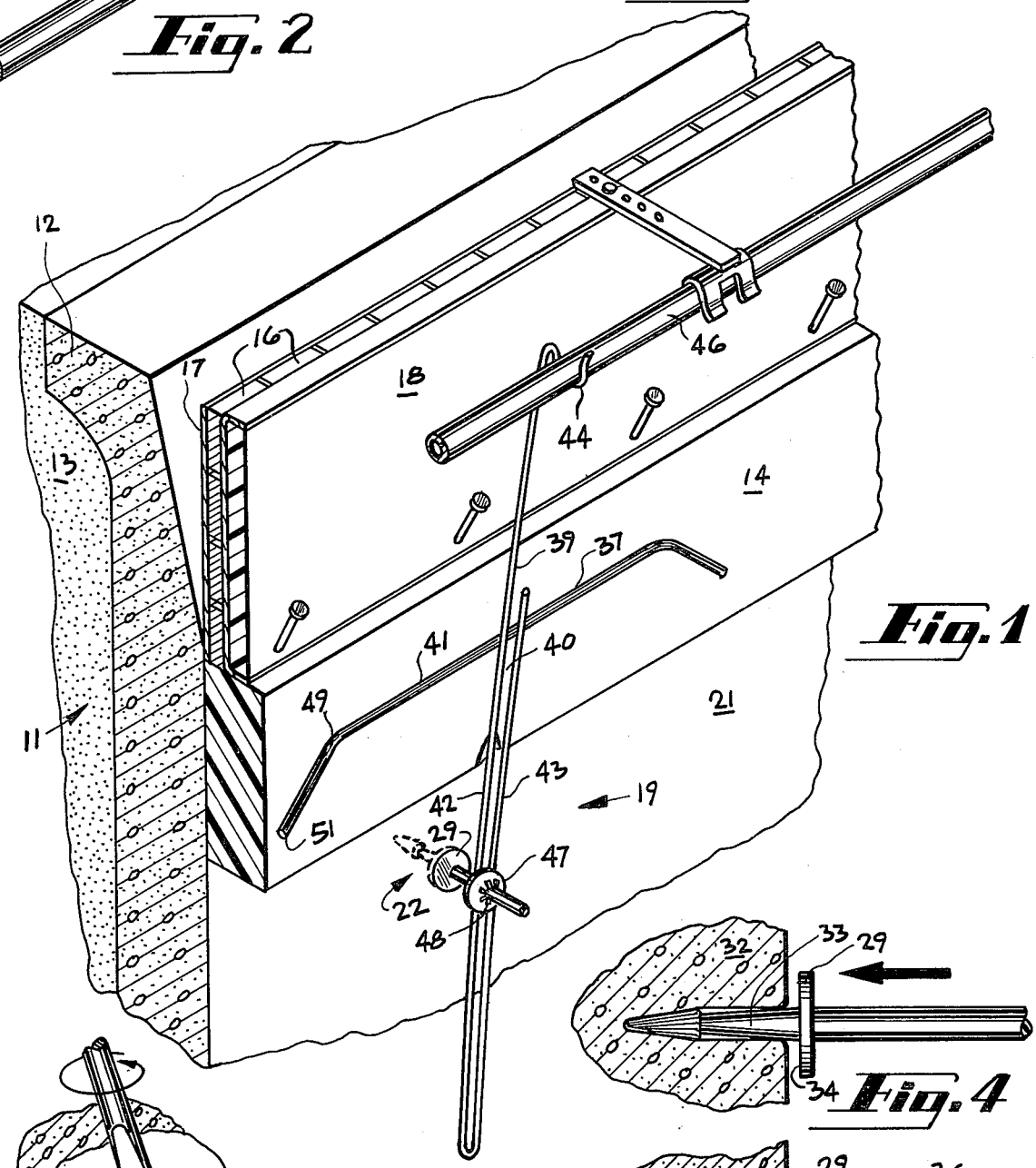
Fig. 1
Fig. 4
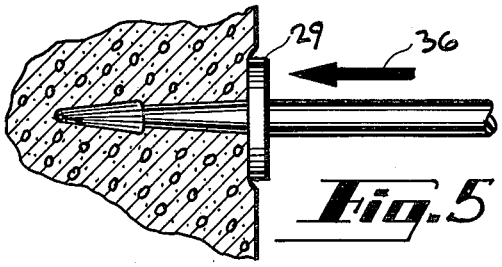
Fig. 5
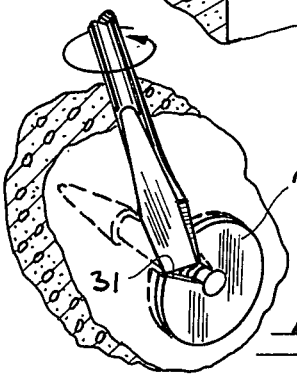
Fig. 8

APPARATUS FOR CONFINING A FORM BOARD AGAINST A WALL

CROSS REFERENCE TO RELATED APPLICATION

The application is a continuation-in-part of my copending application Ser. No. 438,018 filed Jan. 30, 1974, now U.S. Pat. No. 3,904,717, for APPARATUS FOR AND METHOD OF EQUIPPING SWIMMING POOLS AND THE LIKE WITH A TILE BAND AND CANTILEVER DECK, the subject matter of which is hereby incorporated into this application by reference.

BACKGROUND OF THE INVENTION

The present invention relates to the construction of swimming pools and other concrete structures and, more particularly, to apparatus for providing an anchor in concrete and confining board structure against a wall.

Permanently installed backyard swimming pools typically are formed y excavating a hole in the ground generally following the contour desired for the pool, and then lining the hole with reinforcing steel on top of which a cement mixture is sprayed to form a concrete bottom and concrete side walls. A thickened concrete portion, referred to in the art as a "bond beam," is provided around the pool at the top of the side walls to structurally define the peripheral edge of the pool and tie together the pool side walls. After the concrete forming the pool bottom, side walls and bond beam have cured sufficiently, the cavity defining faces of the concrete are covered with a suitable finishing material. A concrete deck or walkway having a surface texture of a desired type is also provided around the pool edge.

It is now common to finish most of the interior wall surfaces of a swimming pool by facing the same with a finishing coat of a fine aggregate concrete or the like. It is generally necessary, though, to provide a horizontal row of tile adjacent the upper edge portion of the pool side walls at the elevation at which the water level is to be maintained in the pool. The purpose of such tile band is to provide a hard, strain-resistant wall surface at the pool waterline to facilitate removal of body oils and other debris which collect on the water surface and adhere to the pool wall at the waterline.

After concrete for the tile band has been secured to the pool wall during construction of the pool, the deck around the edge of the pool is poured. In this connection, a form is positioned along the band, with a portion thereof projecting upwardly beyond the edge of the pool. The form provides a surface configuration above the pool wall against which the deck concrete is poured to apply a desired surface configuration to the inner edge of the deck. The upper surface of the deck is texturized or otherwise finished, and the pool walls below the band of tile are covered with a finishing coating in order to complete the pool.

In the construction of a pool as described above, it is desirable to affix board structures of one sort or another to the concrete pool wall for various purposes. For example, a ledger board is now typically secured to the pool wall to define an appropriate horizontal alignment for the tile band and to support tile when it is secured to the wall. Alternatively, the pool wall itself can provide proper tile alignment in accordance with the method and apparatus described in my copending patent application Ser. No. 483,222, filed June 26, 1974, for FORM BOARD FOR SWIMMING POOL BOND BEAM AND METHOD UTILIZING THE SAME FOR SECURING A ROW OF TILES IN ALIGNMENT ALONG AN IRREGULAR FACE OF A SWIMMING POOL BOND BEAM. While such method and apparatus eliminates the necessity of a ledger board, it does require a form board to be supported horizontally along the concrete wall. Irrespective of the particular manner in which the tile is aligned and secured to the swimming pool wall, a deck form board is then secured to the wall to define the inner edge or boundary of the deck as discussed above.

From the above, it will be seen that it is necessary to secure one or more difficult elongated board structures temporarily to a concrete wall of a swimming pool during the construction of such pool. My copending application Ser. No. 438,018, now U.S. Pat. No. 3,904,717, describes and claims both a method and apparatus for providing such a temporary securance. The present invention represents improvements to such apparatus.

SUMMARY OF THE INVENTION

The present invention provides an anchor designed to be inserted in unset concrete or the like, which anchor is particularly useful for securing a holder structure against a concrete wall in a manner permitting the location of the holder along the wall to be adjusted for, for example, enabling the holder to confine a plurality of differing board structures against the wall at differing distances from the anchor. In its basic aspects, the anchor includes an elongated shank which is equipped adjacent one end with a laterally projecting barb for resisting extraction of such shank from any concrete into which it is inserted, and a laterally projecting packing member spaced from the barb in trailing relation therewith relative to the penetration of concrete by such shank in order to abut the surface of the concrete and urge concrete toward the barb. The method of providing the anchor in concrete includes inserting the shank barb first into unset concrete to a depth which abuts the packing member against the exterior surface of the concrete. Thereafter, the anchor is pushed inwardly to press the packing member against the concrete surface and thereby urge concrete toward the barb. This will assure the presence of concrete behind the barb to resist extraction of the anchor after the concrete is set. As will be described in more detail hereinafter, the anchor is, however, adapted to facilitate removal, after the anchor's function is served, of that portion of it which projects exterior to the wall surface.

The invention also includes an elongated holder which is especially adapted for use with the anchor in confining a board structure against a wall, such as against the concrete wall of a swimming pool under construction. The holder has a longitudinally extending slot intermediate its end through which the shank of the anchor is fittable in sliding relationship. The result is that the location of that portion of the holder which engages a board structure is adjustable in a simple manner along a wall. The holder also has a cross member at the location at which a board structure is to be confined against a wall, which cross member is especially adapted to provide stable engagement of the board. More particularly, such cross member provides board engaging points at least at two positions which are spaced from one another along the longitudinal direction of the holder.

The invention includes other features and functions which will be described or will become apparent from the following more detailed description of preferred embodiments.

BRIEF DESCRIPTION OF THE DRAWING

With reference to the accompanying three sheets of drawing:

FIG. 1 is a broken isometric view illustrating holder structure of the invention as used in confining a ledger board and tile holding structure horizontally along a concrete wall for a swimming pool;

FIG. 2 is an enlarged isometric view of a preferred embodiment of an anchor of the invention;

FIG. 3 is an elevation section of the anchor of FIG. 2;

FIGS. 4 and 5 are enlarged sectional views illustrating successive steps in providing an anchor in concrete in accordance with the method of the invention;

FIG. 8 is an enlarged partial view illustrating the manner in which the exterior portions of the anchor of FIG. 2 are removed from the concrete wall after the anchor's function is served;

DETAILED DESCRIPTION OF THE PREFERRED EMBODIMENTS

Figure 6:
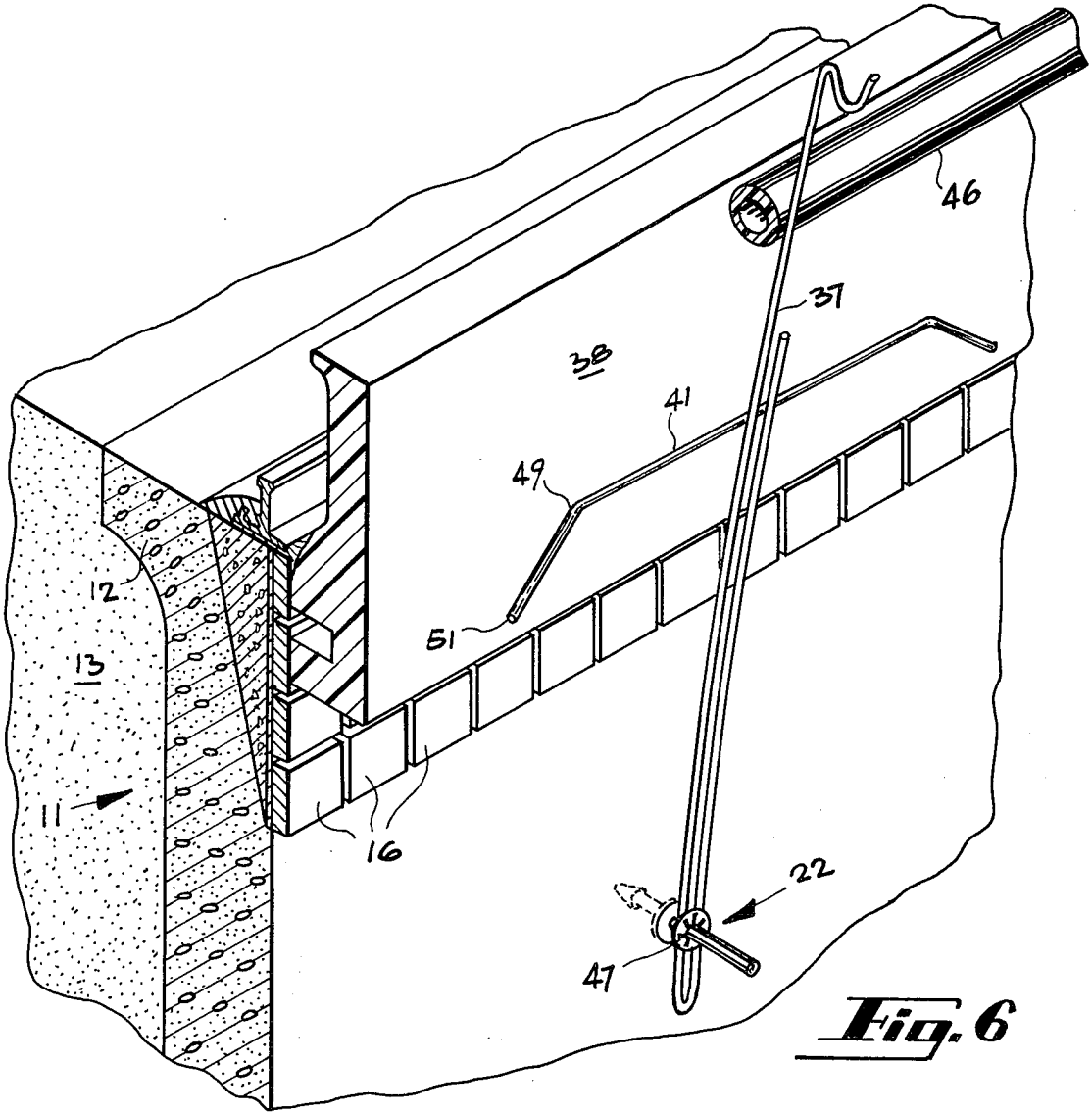
FIG. 6 is a broken isometric view similar to FIG. 1, but illustrating the holder structure of the invention in use confining a cantilever deck form board against a swimming pool wall.

The invention will be described in detail in connection with the construction of a vertical wall of a swimming pool, although as will be apparent its use is not so limited. A portion of a swimming pool wall is generally referred to by the reference numeral 11 and includes an upper enlarged end portion 12 referred to in the art as a bond beam. The purpose of bond beam 12 is both to provide structural strength at the upper edge of the pool and to tie together the side walls of the pool. Although not shown, both the pool side walls and the bond beam are curved or angled at various locations along their length as conventional to thereby define an enclosed cavity for containing water.

A pool sidewall such as that shown typically is formed by spraying under pressure a Gunite or other concrete mixture against a form which, to a large extent, is provided by the earthen mass bordering the cavity within which the pool is to be constructed. The earthen mass is represented in the figures at 13. Before the concrete is sprayed, reinforcing steel or the like is often provided along the walls of the earth cavity so that the wall structure will be of a reinforced concrete construction. It should be noted that the particular manner in which a pool is constructed is generally immaterial to the invention and is being described only for the sake of clarity and to provide an environment within which the invention is particularly useful.

After a swimming pool wall is formed structurally with concrete, for example as described above, it is most often desirable to provide a surface finish thereon, as well as to construct a deck peripherally circumscribing the pool. As one aspect of finishing the pool wall, a row or band of ceramic tile whose function is to collect body oils and the like is applied on the wall at the water level. While being applied to the wall, the tiles are often supported in proper alignment on a ledger board, such as the board 14 shown in FIG. 1, which is temporarily secured to the pool wall for this purpose.

The tiles illustrated in FIG. 1 are in the form of a plurality of mosaic tiles 16 which are secured together via a web backing 17 as is conventional. A support structure including a tile backing member 18 can also be provided for maintaining the mosaic tile sheet in a generally vertical plane, which support structure is described in detail in U.S. Pat. No. 3,904,717 which can be referred to for a detailed description of such arrangement.

Insofar as the present invention is concerned, it is not necessary that the tiles be applied to the wall surface with a ledger board 14 or other support structure. For example, the tiles may be applied to the wall surface after the wall surface itself has been properly prepared for the tiles as described and claimed in my other copending patent application Ser. No. 483,222 mentioned above.

A plurality of holder structures, one of which is illustrated in FIG. 1 and generally referred to by the reference numeral 19, are spaced along the wall for use in confining the elongated ledger board 14 horizontally against the surface 21 of such wall. As a particularly salient feature of the instant invention, the holder structure includes an anchor 22 which is especially adapted to resist premature extraction from the concrete wall. As is best illustrated in FIGS. 2 and 3, the anchor 22 includes an elongated shank 23 having a barb 24 at the forward end thereof. Barb 24 is generally conical in shape with the apex 26 thereof defining a reduced cross-sectional area at the forwardmost section of the shank to facilitate penetration thereof into concrete. The barb is triangular in longitudinal cross-section, and the base 27 thereof defines an annular face which circumferentially surrounds the shank and projects laterally therefrom.

Anchor 22 further includes a packing member which projects laterally from the shank at a location spaced along such shank away from the barb in trailing relation thereto, relative to penetration of concrete by the anchor. More specifically the shank 23 has a circumferential groove or reduced diameter portion 28 within which a packing member washer 29 is fitted. As best seen in FIG. 2, the washer 29 has a section removed therefrom to define a radial slot 31 projecting from its outer to its inner periphery.

The method for inserting the anchor into concrete in a manner which assures that the anchor will be constrained by the concrete once such concrete is set, is best understood with reference to FIGS. 4 through 6. The shank of the anchor is inserted into unset concrete as represented at 32 in FIG. 4, with the barb 24 leading the packing member 29. As illustrated in such figure, upon being so inserted into the concrete, the barb 24 will separate the concrete, with the portion 33 of the shank immediately following the barb entering the bore within the concrete formed by the conically shaped barb. It will be recognized that because the base 27 of the barb projects laterally beyond the shank portion 33, the bore formed in the unset concrete by such barb will generally have a larger diameter than the shank 33. Thus, if the packing member 29 and the method of inserting the shank to be described were not provided, it generally would be a fairly simple matter to remove the anchor from the concrete after it is set, merely by applying a longitudinal force on the anchor tending to pull the same from the concrete. This would be true even if the barb did not extend laterally beyond the shank portion 33, but was radially coterminus therewith. That is, while in such an arrangement the bore formed by the shank portion 33 within the concrete generally would not have a larger diameter than such shank portion, the concrete would have substantially no lateral grip on the shank, with the result that relatively little force would be required to extract the anchor shank from the concrete.

The packing member 29 cooperates with the laterally projecting base or ledge 27 of the barb to inhibit such unwanted extraction. More particularly, the packing member 29 provides a face 34 which circumferentially surrounds the shank and is abuttable against the surface of the concrete when the anchor is inserted therewithin. As a salient feature of the method, it includes the step of pressing the packing member 29 against the surface of the concrete as represented in FIG. 5 by the arrow 36. Such pressing of the packing member against the concrete will compact such concrete at the packing member location. More importantly, the concrete will be urged toward the laterally projecting base 27 of the barb 24 and generally will fill any open space between the packing member and such barb. That is, because such pressing of the unset concrete by the packing member will tend to compress the concrete, the concrete will flow into an unoccupied space around the shank portion 33. Once the concrete is set thereafter, the engagement of the laterally projecting face 27 of the barb with the concrete will resist any longitudinal force on the anchor tending to extract the same from such concrete. Thus, the packing member and the laterally projecting ledge or base provided by the barb cooperate to assure that the concrete securely grips the anchor and inhibits any premature removal of it from the concrete wall.

Figure 7:
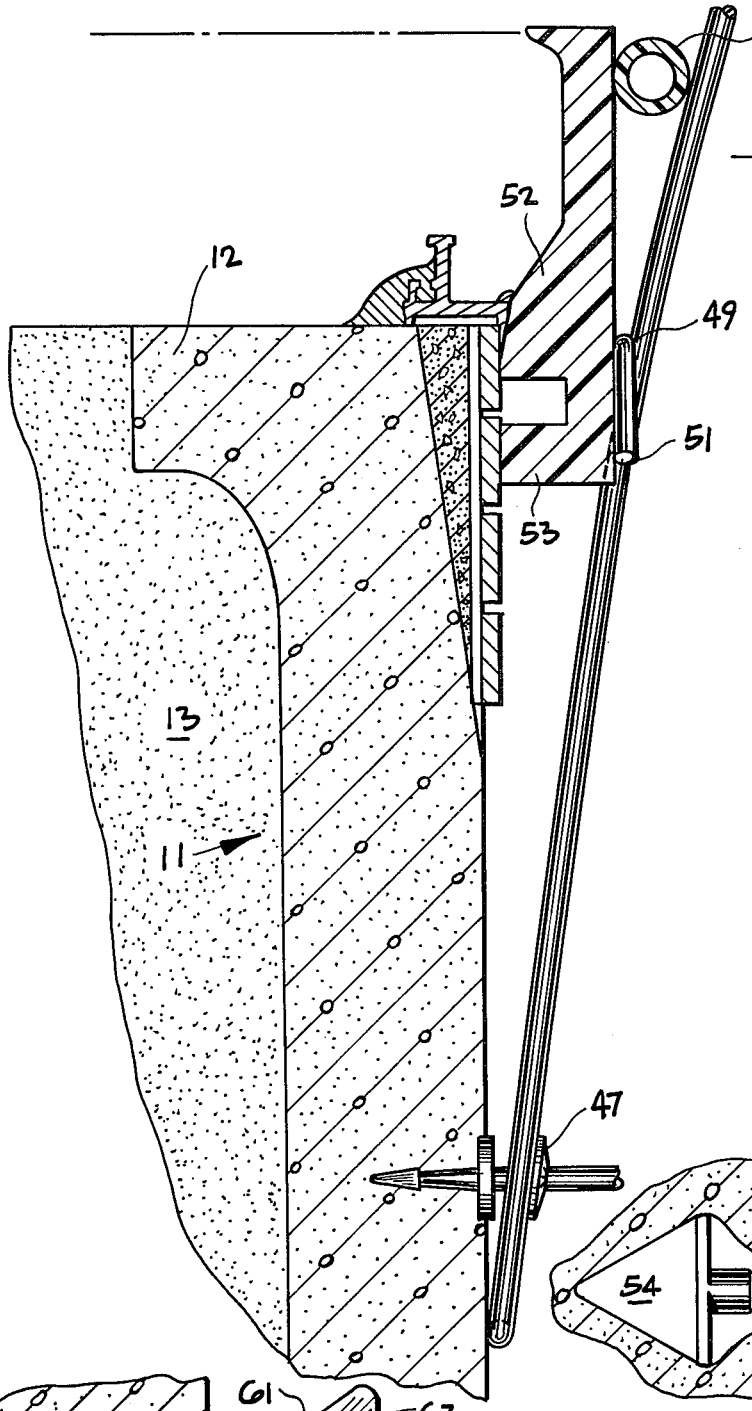
FIG. 7 is an enlarged, side sectional view of the arrangement of FIG. 6, illustrating the manner in which the holder structure stably engages the deck form board.

The holder structure 19 of the invention further includes an elongated spring holder 37 which is especially adapted for use with an anchor, such as the anchor 22, in a manner which enables the location of such holder along the wall to be adjustable. In this connection, during the construction of swimming pools, it is generally desired that several different board structures similar to the ledger board 14 be confined against the wall surface 21 at differing locations. For example, after the tile 16 is secured to the pool sidewall by, for example, the method described in more detail in U.S. Pat. No. 3,904,717, the ledger board is removed and a deck form for defining the inner edge of a deck for the pool is confined against the pool sidewall. More particularly, as is illustrated in FIG. 6, a deck form 38 is confined by the spring holder 37 along the upper edge of the tile band provided by the tile 16, with the deck edge shaping portion thereof projecting above the pool sidewall. To facilitate adjustment of the location of the spring holder to accommodate either one of the board structures 14 or 38 or, for that matter, any other board structure which might be desired to be confined against the wall in the vicinity of such holder, the main longitudinal leg 39 of spring holder 37 has a longitudinal slot 40 extending intermediate its ends and through which the shank 23 of the anchor is fittable in sliding relation thereto. As will be apparent from comparing FIGS. 1 and 6, because of such sliding arrangement, the position of the cross member 41 of the holder relative to the anchor 22 can be changed in a simple manner without the necessity of removing the holder from the anchor shank. That is, the ledger board 14 being engaged in FIG. 7 by the cross member 41 and confined against the pool wall is positioned below the location for the tile, whereas the deck form board 38 engaged by the cross member in FIG. 6 is positioned along the upper portion of the tile band.

The holder 37 is desirably constructed of spring steel rod, and the slot 40 is simply defined by a spring rod being folded back upon itself to provide a pair of spaced-apart, parallel spring rods 42 and 43. As illustrated, the rod 42 extends upwardly beyond the cross member 41 and terminates at its upper end in a U-shaped receiver 44 into which a tubular support 46 for the backing member 18 is seated as described in more detail in U.S. Pat. No. 3,904,717. When the spring holder is being utilized to confine the deck form board 38 against the pool wall as depicted in FIG. 6, the tubular support 46 is positioned between the upper end portion of the spring holder and the deck form as illustrated.

As can be seen from FIGS. 1 and 6, the holder is, in effect, a lever with the anchor 22 acting as the fulcrum. That is, a first end portion of such holder, i.e., that end portion having the cross member 41, is on one side of the anchor, whereas a second end portion, the bottom portion, is on the opposite side of the anchor in bearing juxtaposition with the wall. In this connection, means are provided for securing the holder on the shank. That is, lock washer connector 47 peripherally surrounds and grips the shank of the anchor at a location rearwardly of the spring holder, whereby such lock washer will block removal of the spring holder from the shank. The lock washer is of the type which includes a plurality of rearwardly facing prongs 48 which engage the shank and prevent sliding motion of the washer on the shank rearwardly relative to the direction of insertion of the anchor in the concrete wall.

The manufacture of the holder from spring steel rods not only simplifies provision of the slot 39, but also aids in assuring a secure maintenance of a board structure against a concrete wall. More particularly, the holder becomes a spring component similar to a leaf spring and because of the levering action discussed above, provides a spring force along its length effective to develop a bending moment on said holder adjacent the anchor shank to which such holder is secured. The result is that the holder is forced toward the board structure and thereby confines it against the wall.

It will be noted that the location of the lock washer on the shank is adjustable along the length of such shank. Thus, the distance at which the holder is secured on the shank from the concrete wall is variable. In the construction of swimming pools, the board structures which are to be confined against the pool sidewall typically are confined thereagainst at differing distances progressively further away from the anchor. For example, it will be noted that the position shown in FIG. 6 of which the deck form is confined against the tile band is further from the anchor than is the position at which the ledger board 14 is earlier confined against the wall to support the tile band at the time it is being applied to the swimming pool wall. When instead of use of a ledger board, the upper edge of the pool is conditioned to provide proper alignment of the tile in the manner described in my copending application Ser. No. 483,222, the form used for such purpose is also positioned closer to the anchor than the form board. This desire to confine the boards at differing distances progressively further away from the anchor fulcrum lends itself to the use of a one-way connector lock washer 47. More particularly, as the differing board structures are to be confined against the wall at distances progressively further away from the anchor, the lock washer need only be adjusted inwardly on the shank in order to maintain the cross member at a selected distance from the wall, even though the distance between the cross member and the shank is changed.

The holder of this invention represents an improvement over the holder described and claimed in U.S. Pat. No. 3,904,717 in another important respect. More particularly, the cross member 41 which extends transversely of the main longitudinal leg of the holder and terminates on opposite sides thereof is arranged to provide more stable engagement of the board structure being supported thereby. That is, each outer end portion of the cross member rod is turned or bent at 49 to displace the extreme end 51 of such portion downwardly relative to the main rod of the cross member 41. Both the bend 49 and the end 51 of the cross member rod are generally in the same plane as the main longitudinal leg of the holder with the result that the cross member has on each side of the leg at least two board engaging points, the turn 49 and the end 51 which are spaced from one another with a directional component defined by a line extending between the end portions of the main leg of the holder. The result will be that the holder will provide stable engagement of the board in the direction of said component. This is particularly important when the holder is utilized to confine a deck form of the type illustrated against a concrete wall. More particularly, as can be seen from FIG. 7, the turn 49 of each cross member portion engages the form at a location on the surface thereof which is opposite an upper foot 52 engaging the tile band, whereas the end 51 of each portion will engage such surface at a location opposite a lower foot 53 of the form. This provision of two form board engaging points on each side of the longitudinal leg reduces any tendency of the holder to apply turning leverage on the form because of the generally oblique relationship of such holder to the form boards.

After the board structures 14 and 38 have served their purposes, i.e., after the application of the tile band to the pool wall and the formation of the pool deck, the holder structures spaced along the pool wall are removed therefrom. This is simply accomplished merely by severing the anchor shank adjacent the pool wall and thereby releasing therefrom that portion of the anchor securing the spring holder to the wall. As mentioned previously, it is usual to apply a finishing layer of plaster or the like to all exposed surfaces of the pool wall beneath the tile band. Once the shank of each of the anchors has been so severed, the remaining portion of each anchor will be imbedded within the concrete wall of the pool. However, the packing member presents a somewhat significant surface area over which it is desired to apply plaster and might, in time, result in a plaster bubble or the like at its location. For this reason, the packing member 29 is removably secured to the shank. More particularly, the purpose of the slot 31 in the packing member is to enable gripping of such packing member for such removal after setting of the concrete. Such removal is simply accomplished in the manner illustrated in FIG. 8. That is, after the anchor shank is severed the tool end of a screwdriver or the like can be inserted within the slot to forceably expand the same and eliminate any grip between the packing member and the reduced diameter portion of the shank within which it is fitted. Manipulation of the screwdriver will, therefore, enable the packing member to be simply removed from the shank in order to leave merely the cross section of the reduced portion of the shank exposed to plaster.

Figure 9:
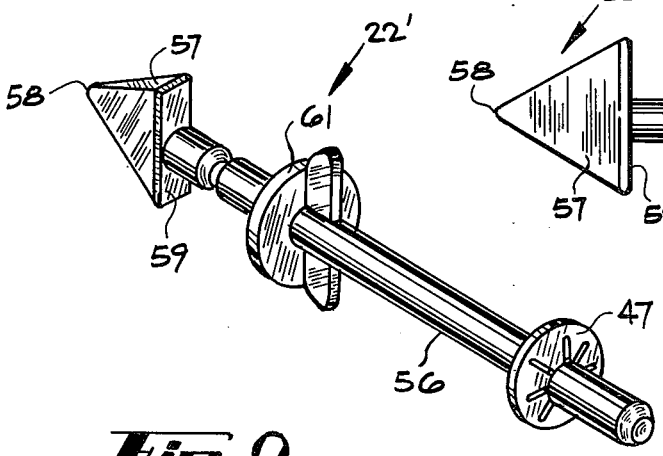
FIG. 9 is an enlarged isometric view of another preferred embodiment of an anchor of the invention.
Figure 10:
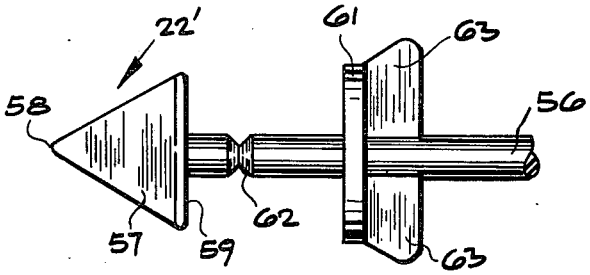
FIG. 10 is an enlarged elevational view of the anchor of FIG. 9.
Figure 11:
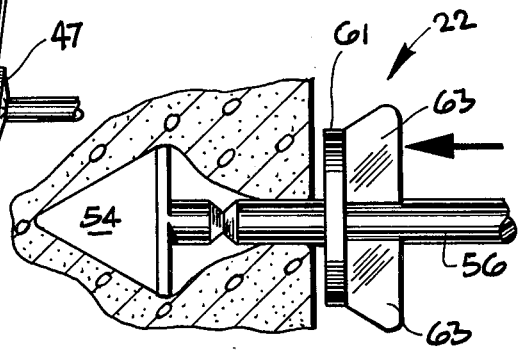
FIGS. 11, 12 and 13 are enlarged cross-sectional views of a concrete wall illustrating the manner in which the alternate anchor of the invention is secured within such a wall and its exterior portions are thereafter removed from the concrete wall after the anchor's function is served.
Figure 12:
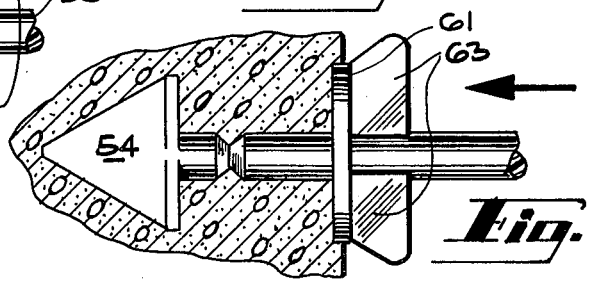

FIGS. 9 and 10 illustrate another embodiment of the anchor of the invention which is especially adapted to facilitate its removal from the concrete wall after its function has been served. The anchor 22' illustrated in such figures is similar to the one previously described in that it includes an elongated shank 56 having a laterally projecting barb 57 at a first end which has a generally triangular cross section. The apex 58 of such anchor defines a reduced cross-sectional area at the forwardmost section of the shank to facilitate penetration thereof into concrete as previously described, and the base thereof provides a laterally projecting face 59 for engagement by concrete. A packing member 61 peripherally surrounds the shank in trailing relationship to the barb to abut the surface of concrete within which the anchor is inserted and urge concrete toward such barb in the same manner as with the previously mentioned anchor. FIGS. 11 and 12 illustrate the anchor 22' being so inserted into concrete.

Figure 13:
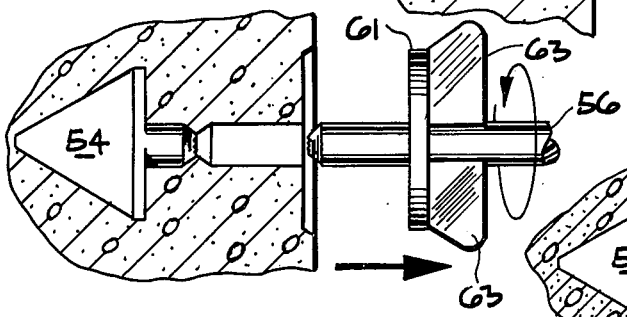

The barb 57 of the anchor 22' differs from the barb 24 of the previously described embodiment in that is is not symmetrical with respect to the longitudinal axis of the shank. That is, rather than being conical, the barb 57 is pyramidal in shape with a rectangular base. Moreover, the shank 56 includes a weakened portion between the barb 57 and the packing member 61 in the form of a circumferential groove 52. The weakened portion is for the purpose of enabling the barb equipped portion of the shank to be separated from the remainder of the anchor and left within the concrete wall. To facilitate such breaking, the anchor 22' further includes laterally extending gripping means in the form of wing projections 63 rearwardly of the packing member adapted to be manually gripped for twisting rotation. The wing projections are secured to the anchor rigidly relative to the shank 53 so that, as is illustrated in FIG. 13, gripping of the same and rotation thereof will result in breaking of the shank at the weakened portion so that the portion of the anchor exterior to the concrete surface can be separated from the concrete. It will be recognized that with this embodiment, the packing member is preferably made integral with the shank so that when the shank is removed, the packing member will also be removed as shown. Thus, when the pool surface is plastered, the plaster will fill the anchor bore remaining in the concrete wall and thereby completely mask the fact that an anchor was secured within the concrete wall during the formation of the pool.

Although the invention has been described in connection with preferred embodiments thereof, it will be appreciated by those skilled in the art that various changes and modifications can be made without departing from its spirit. In this connection, wherever either of the terms "concrete" or "plaster" is used, the term is meant to cover all materials which will set from a liquid to a hardened form. Moreover, although the described anchor embodiments and the spring holder cooperate to provide an especially effective holder structure for boards to be confined against a concrete wall, it will be recognized that the features of each are useful separate from the others. It is, therefore, intended that the coverage afforded applicant be limited only by the spirit of the invention as set forth in the language of the following claims and its equivalent.

I claim:

1. A holder structure for use in confining a relatively wide board structure against a concrete wall comprising:

A. an anchor having an elongated shank equipped with 1. a laterally projecting barb for resisting extraction of said shank from concrete into which the portion of said shank having said barb is inserted prior to the setting of said concrete; and
2. a laterally projecting packing member spaced from said barb in trailing relation therewith relative to penetration of such concrete to abut said wall surface of said concrete and urge concrete toward said barb, said elongated shank extending rearwardly of said packing member for projection from said wall surface after said anchor is secured within said concrete;

B. an elongated holder for confining said board structure against said wall surface, said elongated holder having a longitudinally extending slot intermediate its ends through which said shank is fittable in sliding relation thereto whereby the location of said holder along said wall surface is adjustable, said holder being positioned with a first end portion at the location at which said board structure is to be confined and a second end portion on the opposite side of said anchor in bearing juxtaposition with said wall and being a spring component providing a spring force along its length effective to develop a bending moment on said holder adjacent the shank of said anchor to force the holder toward said board structure;

C. means securing said holder on said shank; and

D. said slot being provided by a pair of spaced apart, parallel spring rods which also define said spring component along the length of said holder.

2. The holder structure of claim 1 further including a cross member on said first end portion of said elongated holder for engagement with said board to provide said confinement thereof against said wall, said cross member having at least two separate board engagement points spaced from one another in a direction having a component parallel to the direction of a line extending between said holder end portions to provide stable engagement of said board by said cross member in the direction of said component.

3. The holder structure of claim 2 wherein said holder includes a main longitudinal leg along which said slot is provided and said cross member extends transversely of said leg on opposite sides thereof, each of the portions of said cross member on each of said sides of said leg having at least two separate board engagement points spaced from one another in a direction having a component parallel to the direction of a line extending between said holder end portions to provide stable engagement of said board by said cross member in both the direction of said component and a direction transverse thereto.

4. A holder structure for use in confining a board structure against a wall comprising:

A. an anchor securable to said wall with a shank projecting adjacent a location at which it is desired said board be confined against said wall;

B. an elongated holder having a longitudinally extending slot intermediate its ends through which said shank is fittable in sliding relation thereto, whereby the location of said holder along said wall is adjustable;

C. means securing said holder on said shank; and

D. said slot being provided by a pair of spaced-apart, parallel spring rods which also define a spring component along the length of said holder.

5. The holder structure of claim 4 wherein said means securing said holder on said shank is adjustable along the length of said shank, whereby the distance at which said holder is secured on said shank from said wall is variable.

6. The holder structure of claim 5 wherein said wall is a concrete sidewall for a swimming pool and a plurality of boards are to be confined against said wall at differing distances progressively further away from said anchor, and said means securing said holder on said shank is adjustable inwardly so as to maintain said first end portion of said holder at a selected distance from said wall even though the distance from said end portion and said shank is changed.

7. A holder structure for use in confining a relatively wide board structure against a wall comprising:

A. an anchor securable to said wall adjacent a location at which it is desired said board be confined against said wall;

B. an elongated holder having a main longitudinal leg securable intermediate its ends by said anchor to said wall with a first end portion of said leg adjacent the location at which said board structure is to be confined and a second end portion thereof in bearing juxtaposition with said wall;

C. means securing said holder on said anchor;

D. a cross member on said first end portion of said leg for engagement with said board to provide said confinement thereof against said wall, said cross member being a rod fixedly related to said leg intermediate its ends and extending transversely with respect thereto on opposite sides thereof, each of the outer end portions of said rod being turned generally in a plane containing a line extending between said first and second end portions of said holder to provide two board engaging points on each side of said leg respectively at the turn location and at the end of said rod;

E. said elongated holder having a longitudinally extending slot intermediate its ends through which a shank of said anchor adapted to extend outward from said wall when said anchor is secured to said wall is fittable in sliding relation thereto, whereby the location of said holder along said wall is adjustable, said slot being defined in said main longitudinal leg by a pair of spaced-apart, parallel spring rods which also provide said leg with a spring force along the length thereof effective to develop a bending moment on said holder adjacent said anchor to force the holder toward said board structure.

* * * * *